US008079625B2

(12) United States Patent
Arney et al.

(10) Patent No.: US 8,079,625 B2
(45) Date of Patent: Dec. 20, 2011

(54) DEVICE FOR OPENING AND CLOSING A ZIPPER

(75) Inventors: Jeffrey Scott Arney, Hickory, NC (US); Serge Levine, Hickory, NC (US)

(73) Assignee: BSN Medical, Inc., Charlotte, NC (US)

( * ) Notice: Subject to any disclaimer, the term of this patent is extended or adjusted under 35 U.S.C. 154(b) by 324 days.

(21) Appl. No.: 12/440,752

(22) PCT Filed: Mar. 10, 2009

(86) PCT No.: PCT/US2009/036655
§ 371 (c)(1),
(2), (4) Date: Mar. 11, 2009

(87) PCT Pub. No.: WO2010/104504
PCT Pub. Date: Sep. 16, 2010

(65) Prior Publication Data
US 2010/0229351 A1 Sep. 16, 2010

(51) Int. Cl.
*A44B 19/00* (2006.01)

(52) U.S. Cl. ..... 294/3.6; 24/429

(58) Field of Classification Search ..... 294/1.1, 294/3.6, 25, 26; 24/429, 430; 223/1, 111; 2/96, 239, 336
See application file for complete search history.

(56) References Cited

U.S. PATENT DOCUMENTS

| | | | | |
|---|---|---|---|---|
| 2,178,885 | A | 11/1939 | Buff et al. | |
| 2,483,057 | A | 9/1949 | Levering | |
| 2,626,440 | A | 1/1953 | Carlile | |
| 4,350,375 | A | 9/1982 | Bako | |
| D291,652 | S * | 9/1987 | Gisiger | D8/331 |
| D293,075 | S * | 12/1987 | Gisiger | D8/330 |
| 4,757,577 | A | 7/1988 | Freeman | |
| 5,975,386 | A | 11/1999 | Fernicola | |
| 6,510,593 | B1 * | 1/2003 | Kim | 24/418 |
| 7,024,701 | B2 * | 4/2006 | Marty et al. | 2/96 |
| 7,039,989 | B2 | 5/2006 | Marty et al. | |
| 7,073,233 | B2 * | 7/2006 | Leva et al. | 24/386 |
| D526,931 | S * | 8/2006 | Koenig et al. | D11/221 |
| 7,506,417 | B2 * | 3/2009 | Yoneoka | 24/430 |

OTHER PUBLICATIONS

International Search Report and Written Opinion from priority PCT Application No. PCT/US2009/036655.

* cited by examiner

*Primary Examiner* — Saul Rodriguez
*Assistant Examiner* — Stephen Vu
(74) *Attorney, Agent, or Firm* — Shumaker, Loop & Kendrick LLP

(57) ABSTRACT

A device for assisting in opening and closing a zipper including a body having first and second diverging guide channels for receiving respective zipper tracks for sliding movement along the diverging guide channels and for progressively interconnecting the tracks at a predetermined mutually oriented angle of closure, a connector carried by the body for connecting the body to the zipper slider, and a pull for permitting manual pulling movement of the body.

13 Claims, 10 Drawing Sheets

DEVICE FOR OPENING AND CLOSING A ZIPPER

TECHNICAL FIELD AND BACKGROUND OF THE INVENTION

This invention relates to a device for opening and closing a zipper, and more particularly to a zipper opening and closing device adapted for being attached to a zipper of a compression hose and permitting manual pulling movement of the device to pull the zipper in a closing direction.

Zippers are used on virtually all types of garments as a means of easily enabling a garment to be donned, and then secured around the body. In many cases, the zipper may be used to close an opening in a garment that has a relatively loose fit, so that the zipper slide is easily moved up and down the opening, as needed. In other types of garments, the opening may be such as to require more force on the zipper, particularly in closing the opening. These garment types include garments such as boots, jackets, purses, backpacks and certain hosiery products.

The particular disclosure and preferred embodiment of the invention as set out in this application relates to compression hose of the type commonly worn to increase blood circulation, usually in a patient's leg. However, the invention is not limited to compression hose, but to any garment or product where assistance in closing a zipper is necessary or desirable. Compression hose function in the required therapeutic manner by tightly fitting around the patient's leg, thereby increasing the blood flow velocity and preventing or reducing blood pooling in the lower extremities. For this reason, compression hose are often fabricated as a shaped elastic panel with a marginal zipper that must be closed to cause the hose to compressively encircle the limb. Because of the need to apply compression to the limb, these zippers are often difficult to open and, particularly, to close, because of tight fit of the garment. In many instances the wearer must have assistance from another person, with one person using both hands to hold the opposing side edges of the elastic panel near each other while the other person pulls the zipper along the length of the side edge to encircle the hose around the leg.

In some instances, the zipping forces on the garment are such that significant stresses are placed on the zipper components because as the zipper closing angle increases, progressively greater lateral stresses are imposed on the zipper tracks, particularly as the zipper slider is being moved in a zipper-closing direction. In some cases, the stresses can be so large that the zipper cannot be closed past a certain position. In other instances the zipper may be damaged or the zipper slider separate from the one or both of the zipper tracks during closing of the zipper. A tool such as a pair of pliers or an elongate hook to engage the zipper slider can be used for facilitating movement of the zipper by allowing even greater force to be applied to the zipper. This increased force may increase the likelihood of damage to the zipper because these tools can apply substantially greater force to the zipper components but do not reduce the zipper closing angle.

Accordingly, a need exists for a device for assisting to move a slider of a zipper that is able to maintain the zipper track at an angle sufficiently small to allow relatively easy manual movement of the zipper slider while avoiding damage to the zipper.

SUMMARY OF THE INVENTION

Therefore, it is an object of the invention to provide a zipper assist device for assisting the opening and closing of a zipper.

It is another object of the invention to provide a zipper assist device that reduces the zipper closing angle, thereby reducing stresses on the zipper.

It is another object of the invention to provide a zipper assist device that is easily installed on a garment or product to be zipped closed, and then removed.

It is another object of the invention to provide a zipper assist device that has sufficient adaptability to be able to fit zippers of varying sizes.

It is another object of the invention to provide a zipper assist device that is portable.

It is another object of the invention to provide a zipper assist device that is detachable from the zipper.

It is another object of the invention to provide a zipper assist device that permits the wearer to don the garment without needing the assistance of another person.

It is another object of the invention to provide a zipper assist device that is ergonomically desirable.

These and other objects and advantages are achieved by providing a device for assisting in zipping a zipper of the type having a central zipper slider for opening and closing the zipper by selectively disconnecting and connecting a pair of opposed interlockable tracks as the zipper slider moves in respective opening and closing directions along the tracks. The device includes a body having first and second diverging guide channels for receiving the respective zipper tracks for sliding movement along the guide channel path length and for progressively interconnecting the interlockable tracks at a predetermined mutually oriented angle of closure, a connector carried by the body for connecting the body to the zipper slider, and a pull for permitting manual movement of the body.

According to another embodiment of the present invention, the connector is an outwardly extending post carried by the body for extending through and engaging an opening in the zipper slider.

According to another embodiment of the present invention, the body has a wedge shape.

According to another embodiment of the present invention, the first and second diverging guide channels define a concave surface with respect to a centerline of the body.

According to another embodiment of the present invention, the pull is attached to the body by a hinged joint.

According to another embodiment of the present invention, each guide channel further includes relatively narrow access slots positioned on a periphery of each guide channel for receiving and retaining each zipper track.

According to another embodiment of the present invention, each of the diverging guide channels includes at least one hook for receiving a lace for tying the first and second diverging guide channels together and forming the body.

According to another embodiment of the present invention, each of the diverging guide channels is attached with a flexible support member connecting to the pull and forming the body.

According to another embodiment of the present invention, the body further includes an alignment plate positioned at a connection point of the connector and the zipper slider for providing sliding support to the zipper during pulling movement of the body for assisting and maintaining the device in alignment with the zipper track. According to another embodiment of the present invention, the device further includes a flap for engaging the post and for retaining an opening of a tab of the zipper slider.

According to another preferred embodiment of the present invention, a device for assisting in zipping a zipper of the type having a central zipper slider for opening and closing the zipper by selectively disconnecting and connecting a pair of opposed interlockable tracks as the zipper slider moves in respective opening and closing directions along the tracks is provided. The device includes a body having first and second outwardly concave diverging guide channels for receiving the respective zipper tracks for sliding movement along the guide channel path length and for progressively interconnecting the interlockable tracks at a predetermined mutually oriented angle of closure, an outwardly extending post carried by the body for connecting the body to the zipper slider for being received by an opening in a zipper slider, and a pull for permitting manual pulling movement of the body.

According to another preferred embodiment of the present invention, a method for assisting in opening and closing a zipper of the type having a central zipper slider for selectively disconnecting and connecting a pair of opposed interlockable tracks as the zipper slider moves in respective opening and closing directions along the tracks is provided. The method includes the steps of providing a device including a body having first and second diverging guide channels for receiving the respective zipper tracks for sliding movement along the guide channel path length and for progressively interconnecting the interlockable tracks. A connector is carried by the body for connecting the body to the zipper slider, and a pull is provided for permitting manual pulling movement of the body. Each track is inserted into a respective guide channel, and the device is moved to a position proximal the zipper slider. The zipper slider is connected to the connector, and the device is moved by manual operation of the pull along the zipper to open or close the zipper.

According to another embodiment of the present invention, the steps of inserting each track into a respective guide channel are performed simultaneously.

According to another embodiment of the present invention, the steps of inserting each track into a respective guide channel are performed sequentially.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENTS AND BEST MODE

Figure 1:
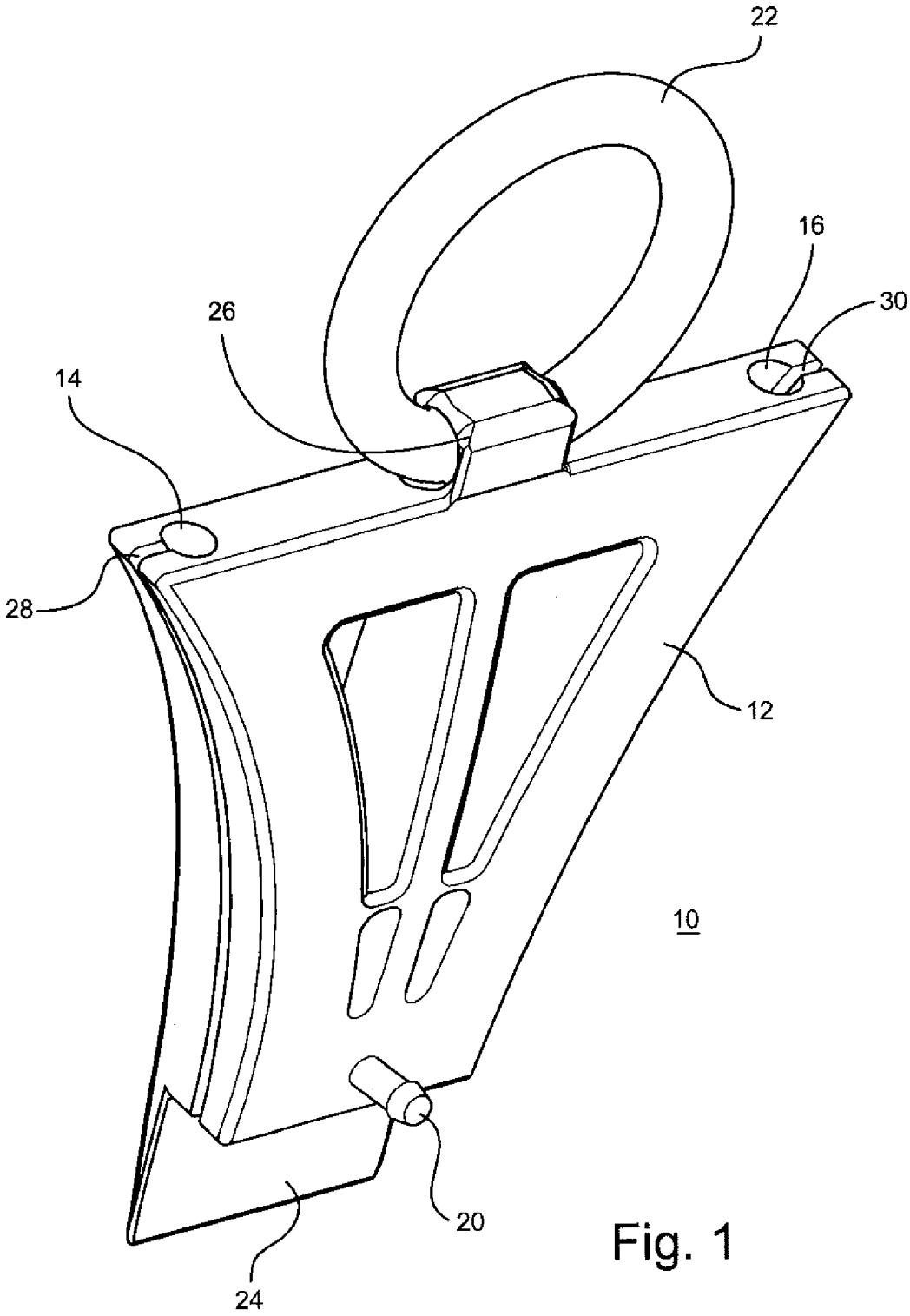
FIG. 1 is a perspective view of a device for assisting in zipping a zipper.
Figure 2:
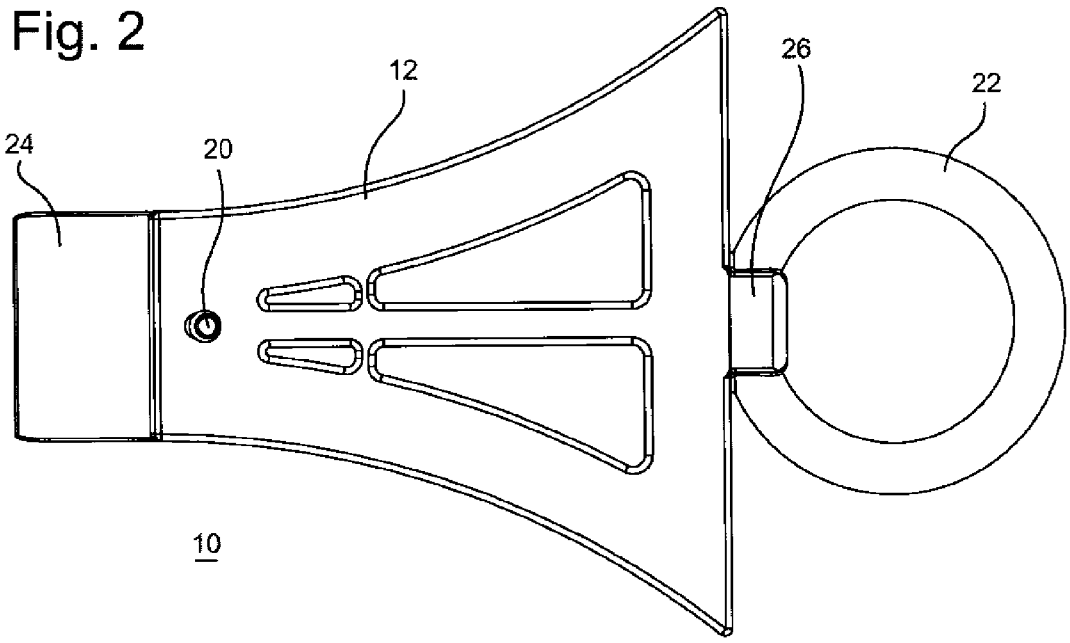
FIG. 2 is a front view of the zipper assist device.

Referring now specifically to the drawings, a device for assisting in opening and closing a zipper, hereinafter referred to as a "zipper assist device", according to the present invention is shown generally in FIG. 1 at reference numeral 10. The zipper assist device 10 preferably includes a wedge-shaped body 12 and a pair of guide channels 14, 16 formed on opposing sides of the body 12. A pull 22 is provided that connects to the body 12 and allows easy manual grasping with one or two fingers to provide movement to the body 12. The body 12 may take any shape that enables the body 12 to draw the tracks 6, 8 together sufficiently to permit easy closure of the zipper assist device 10.

The zipper assist device 10 assists a wearer in pulling a zipper 2 along a pair of tracks 6, 8, to close or open a compression hose product 1 as shown sequentially in FIGS. 6-11. The tracks 6, 8 are typically sewn into the compression hose 1 by stitching. A central slider 4 acts to interlock respective teeth of the pair of tracks 6, 8 to interlock the tracks 6, 8 as needed to operate the zipper 2. The slider 4 includes a tab 5 for pulling the slider. The tab 5 includes an opening 5*a*.

As is shown in the drawings, the compression hose 1 has a relatively tight fit around the patient's leg and may require a substantial pulling force on the zipper 2 to bring the opposing edges of the compression hose 1 together around the leg.

The body 12 may be made out of any suitable material including plastic, metal, or any other known material. The body 12 need not be constructed in the identical shape shown in FIG. 1, and will be effective with any shape that has a generally diverging pair of guide channels 14, 16. The body 12 may include a plurality of voids as shown in FIG. 1, and the voids may be provided for ornamental reasons or to alter the rigidity of the body 12. The body 12 includes a alignment plate 24 positioned on the attachment point end of the body 12, where the zipper tab opening 5*a* connects with post 20. Alignment plate 24 is adapted for sliding underneath and receiving the central slider 4. In this manner, the alignment plate 24 acts to slide underneath the tracks 6, 8, providing guiding support for the central slider 4.

The pull 22 is connected to the body 12 by a structure forming a hinged joint 26. The hinged joint 26 provides for rotation of the pull 22 so that the wearer can easily gain access to the pull 22 from a variety of angles. The pull is shown with a circular shape, but any suitable shape capable of being pulled by the wearer will be appropriate.

Figure 3:
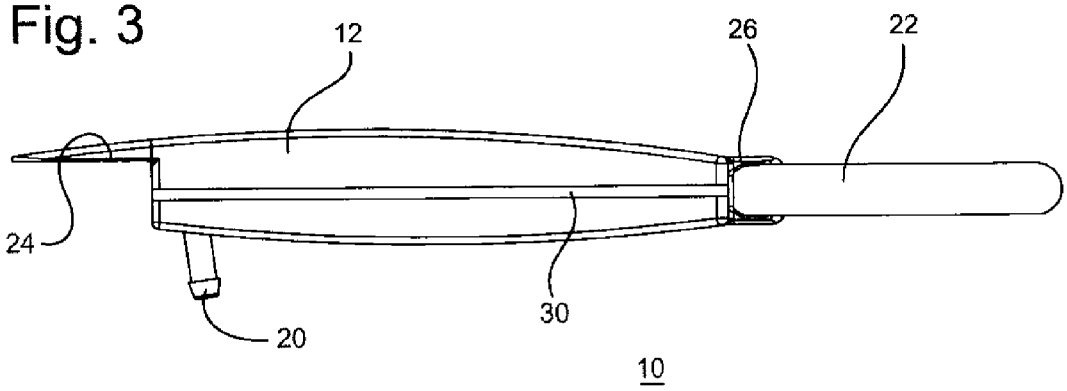
FIG. 3 is a side view of the zipper assist device.
Figure 4:
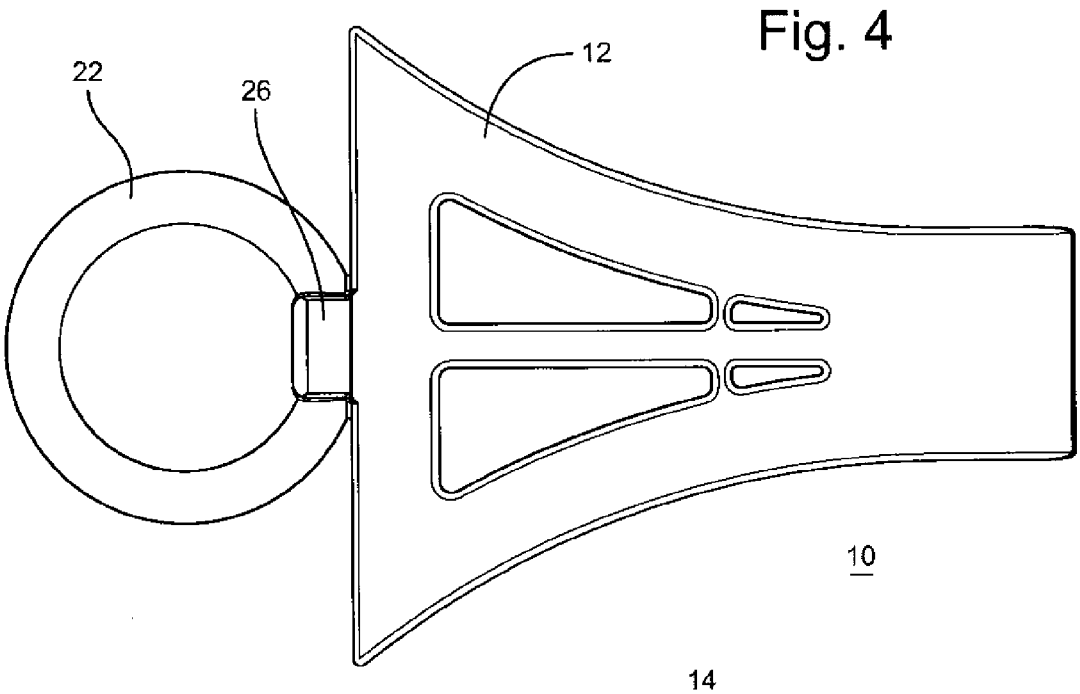
FIG. 4 is a rear view of the zipper assist device.
Figure 5:
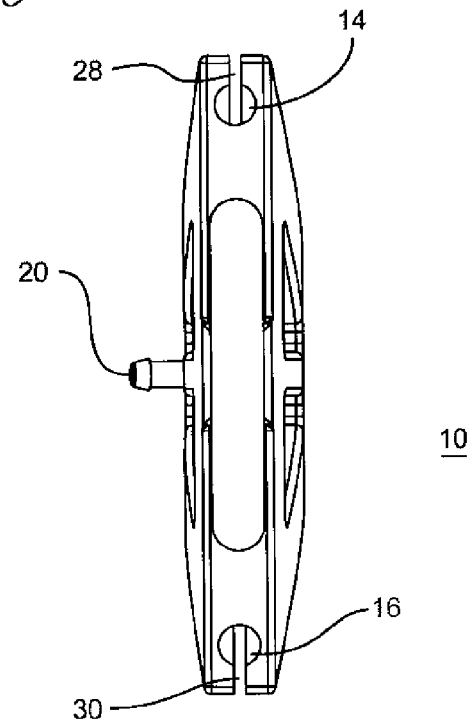
FIG. 5 is a top view of the zipper assist device.
Figure 14:
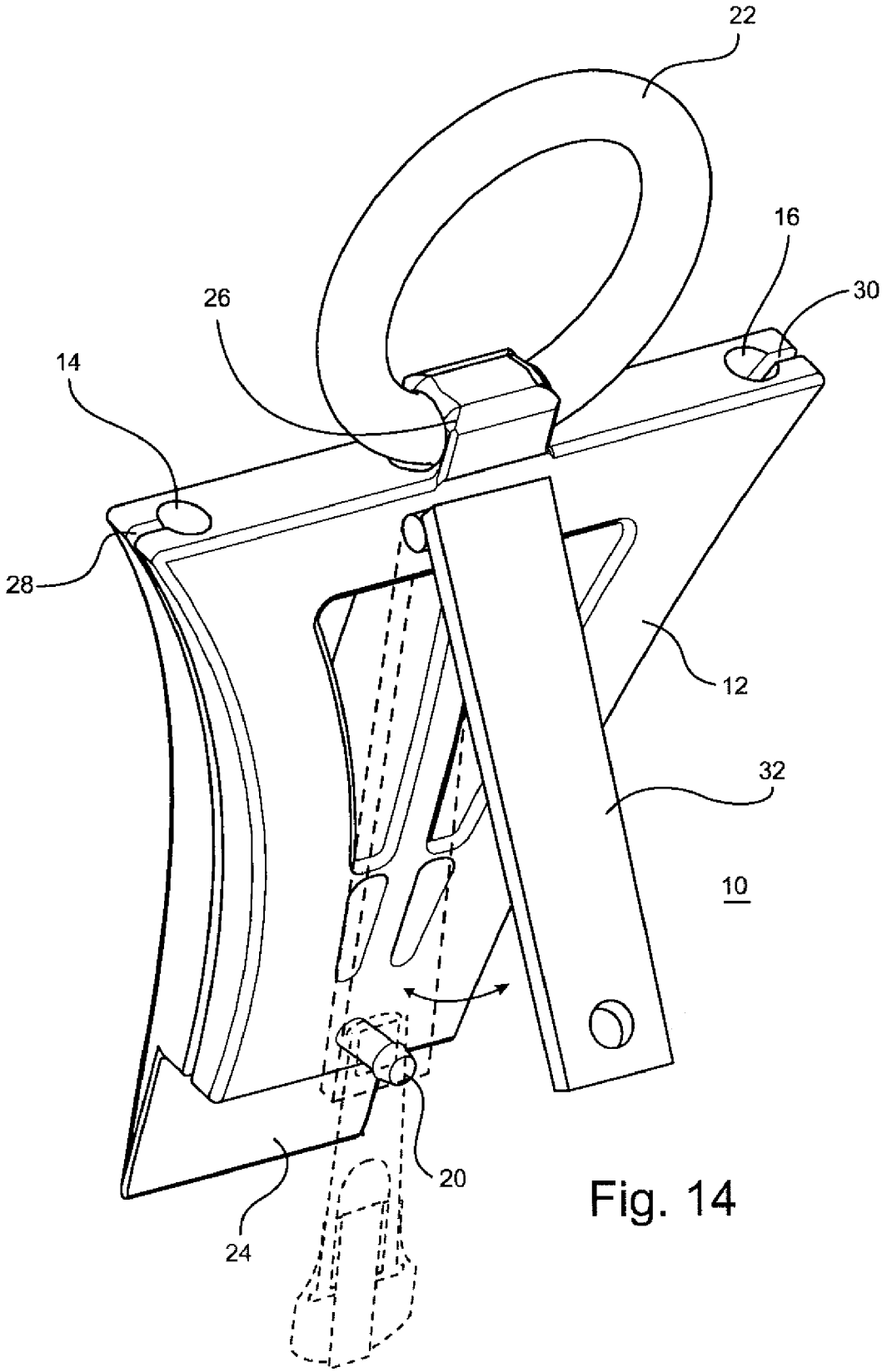
FIG. 14 is a perspective view of the zipper assist device having an engagable flap for maintaining the zipper slider on the zipper assist device.

The body 12 carries post 20 that is adapted for engaging the opening 5*a* of the pull tab 5. The post 20 projects from the body 12 and may optionally angle towards the pull 22 as shown in FIG. 3. In some embodiments, the post 20 may include a retaining flange. Once the central slider 4 is brought proximal to the body 12, the tab 5 is flipped over towards the body 12 until the tab opening 5*a* is in line and engaged with the post 20. An optional flap 32 is shown in FIG. 14 that engages the post 20 when the tab 5 is installed. The post 20 is preferably located in the lateral center and attaching end of the body 12, but its orientation may be changed depending on the tab 5 size, product to be used on, or any other various reasons.

The pair of guide channels 14, 16 are positioned on opposing sides of the body 12. Each channel 14, 16 is shown in a generally concave shape in respect to the center of the wedge-shaped body 14, but can approximate many other shapes. Each channel 14, 16 is cylindrically shaped to receive the teeth portion of a zipper tracks 6, 8. The channels 14, 16 may be made of the same material as the body 12, or may be optionally a different material integrally formed with the body 12. Preferably, the channel 14, 16 is made from a durable and low friction material such as metal, but may optionally be made from Delrin®, Teflon®, or any suitable material. Each guide channel 14, 16 also includes a respective access slot 28, 30 extending from the guide channel. Each access slot 28, 30 is operative to receive the fabric portions of the zipper tracks 6, 8. In this manner, collectively, the access slots 28, 30 and the guide channels 14, 16 approximate the contour of the zipper tracks 6, 8 and retain the zipper tracks in the guide channels 14, 16. The respective shape of each access slot, 28, 30, and each channel, 14, 16, was designed to reduce concentrated stresses and friction. Preferably, the access slots, 28, 30, and the channels, 14, 16, are made of a solid lubricant material.

Figure 6:
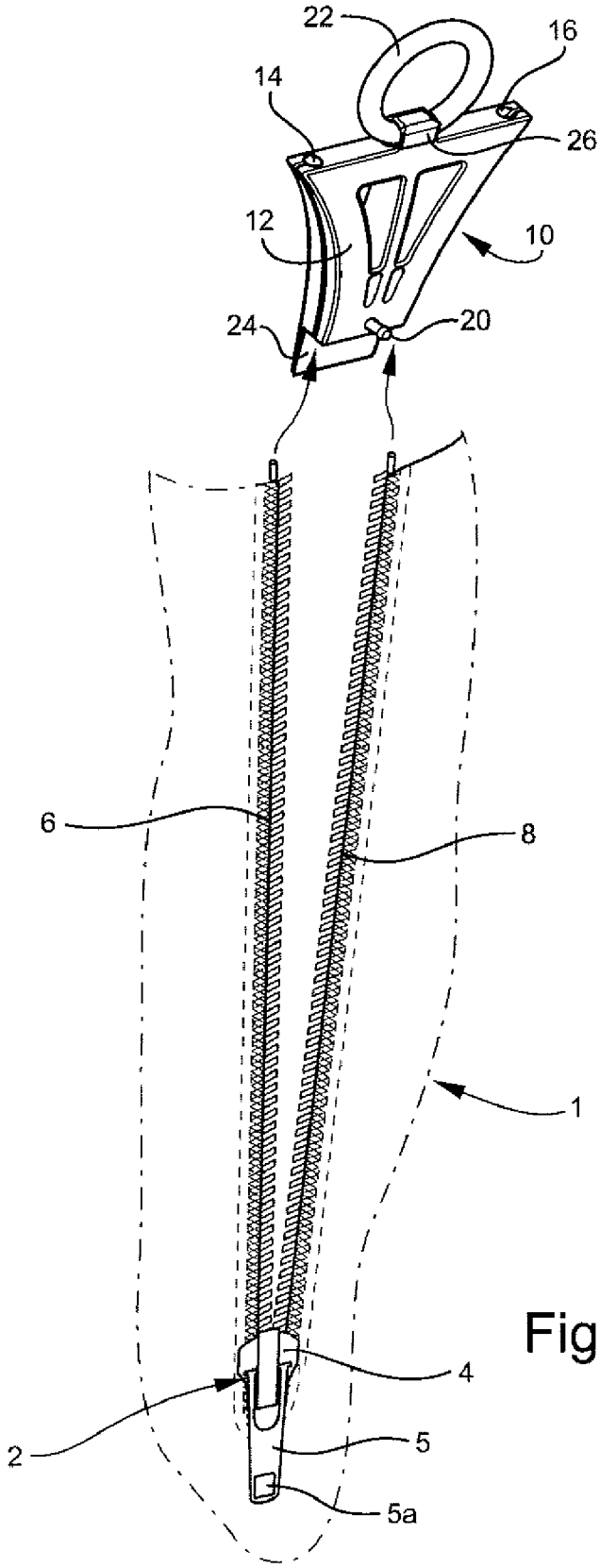
FIG. 6 is a perspective view showing the zipper assist device in position to be installed on a zipper track of a compression hose.
Figure 7A:
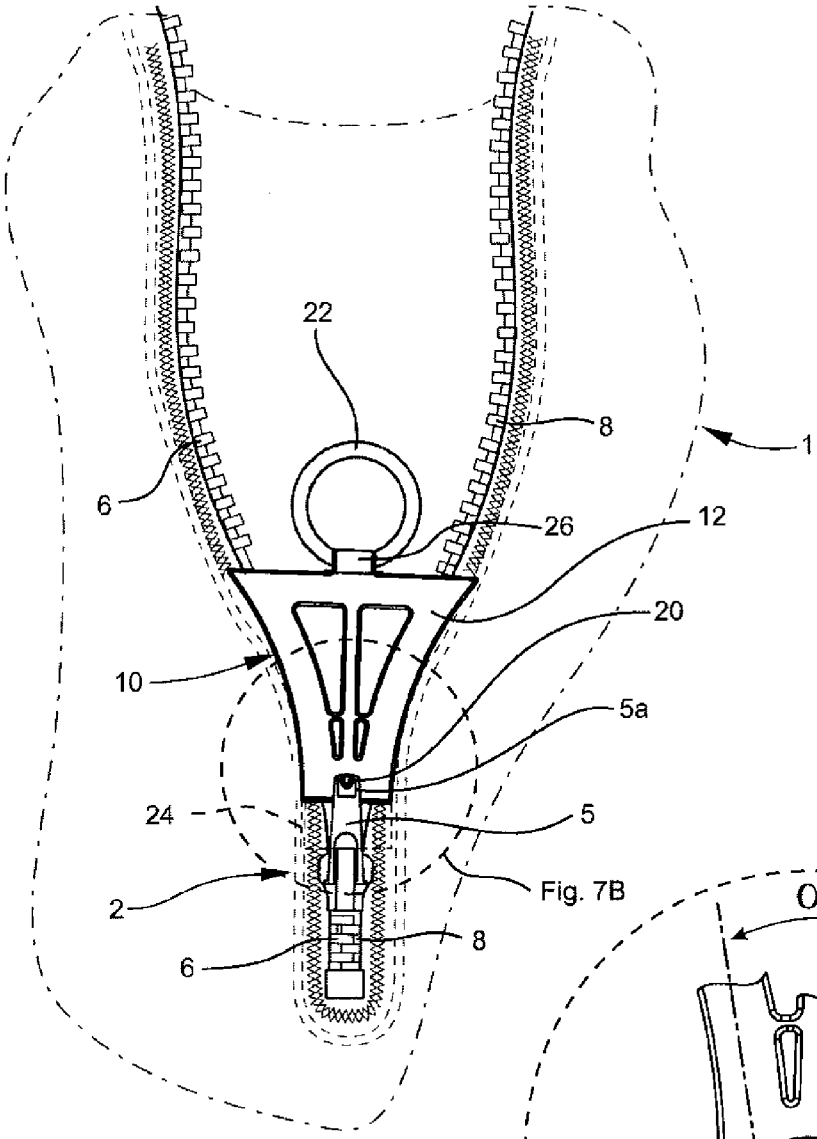
FIG. 7A is a front perspective view of the zipper assist device installed on the zipper track of the compression hose and positioned at the lowest portion of the zipper track.

Operation of the zipper assist device 10 on a compression hose 1 is shown according to FIGS. 6 through 11. As shown in FIG. 6, preferably the central slider 4 of the zipper 2 is in its most unzipped position. In this manner, the zipper 2 can travel no further in the unzipped position because no more zipper tracks 6, 8 remains in that direction. The zipper assist device 10 is then positioned proximal the unzipped portion of the zipper tracks 6, 8, which are shown at the most upwardly position in FIG. 6. Each track 6, 8 is positioned proximal to each respective guide channel 14, 16 of the zipper assist device 10. It may be possible to insert both tracks 6, 8 simultaneously into both guide channels 14, 16, but it is assumed that the wearer will preferably insert one track 6 or 8 into its respective guide channel 14 or 16, at a first time, and then insert the second track 6 or 8 into its respective guide channel 14 or 16, at a subsequent time. As shown in FIG. 7, the zipper assist device 10 is then slid down the zipper tracks 6, 8 until the zipper assist device 10 is in close proximity to the zipper 2. The alignment plate 24 of the zipper assist device 10 slides underneath the central slider 4 thereby providing increased support for the zipper 2. The tab 5 is then flipped upwards in the closing direction and positioned such that the tab opening 5*a* is in line with the connector post 20. Post 20 is then inserted through the opening 5*a*. Once inserted through the opening 5*a*, the flap 32, as shown in FIG. 14, is flipped over and onto the post 20 to further secure the zipper 2 to the zipper assist device 10.

Figure 7B:
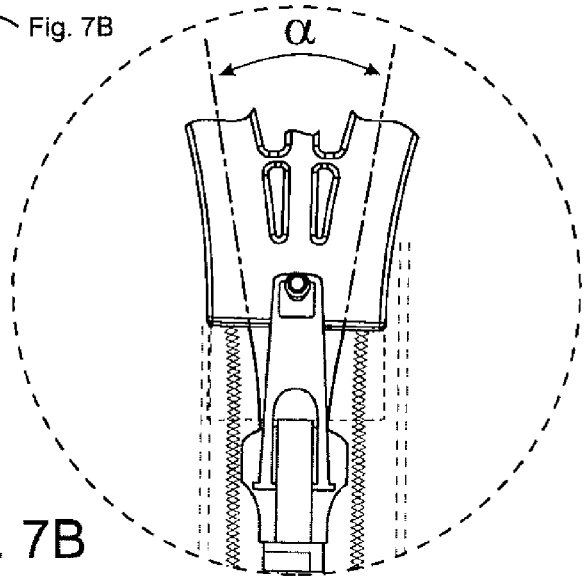
FIG. 7B is an enlarge view of the zipper assist device shown in FIG. 7A.
Figure 8:
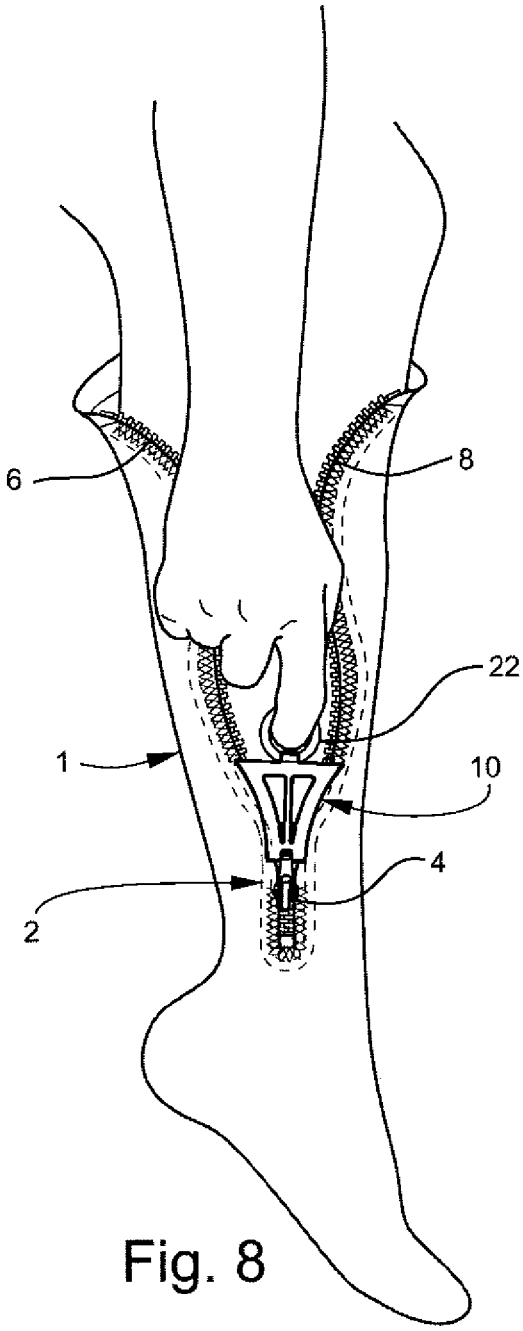
FIG. 8 is a side view of the zipper assist device installed on the zipper track of the compression hose at the lowest portion of the zipper track and engaged by a finger of the wearer while being pulled upwards to zip the zipper.
Figure 9:
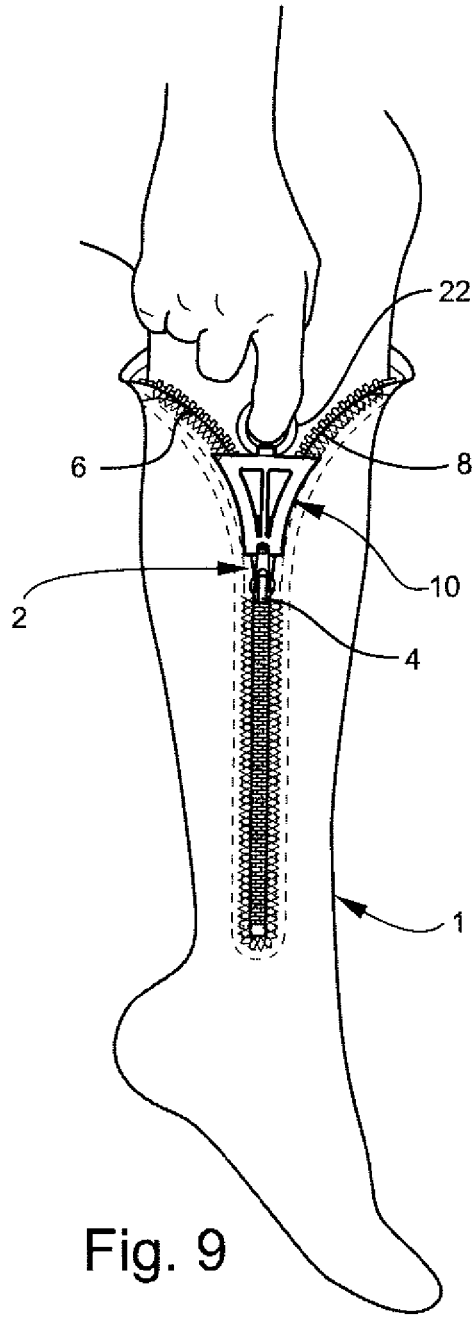
FIG. 9 is a side view sequentially after the view of FIG. 8, showing the zipper assist device installed on the zipper track of the compression hose at a medial portion of the zipper track and engaged by a finger of the wearer while being pulled upwards to zip the zipper.
Figure 10:
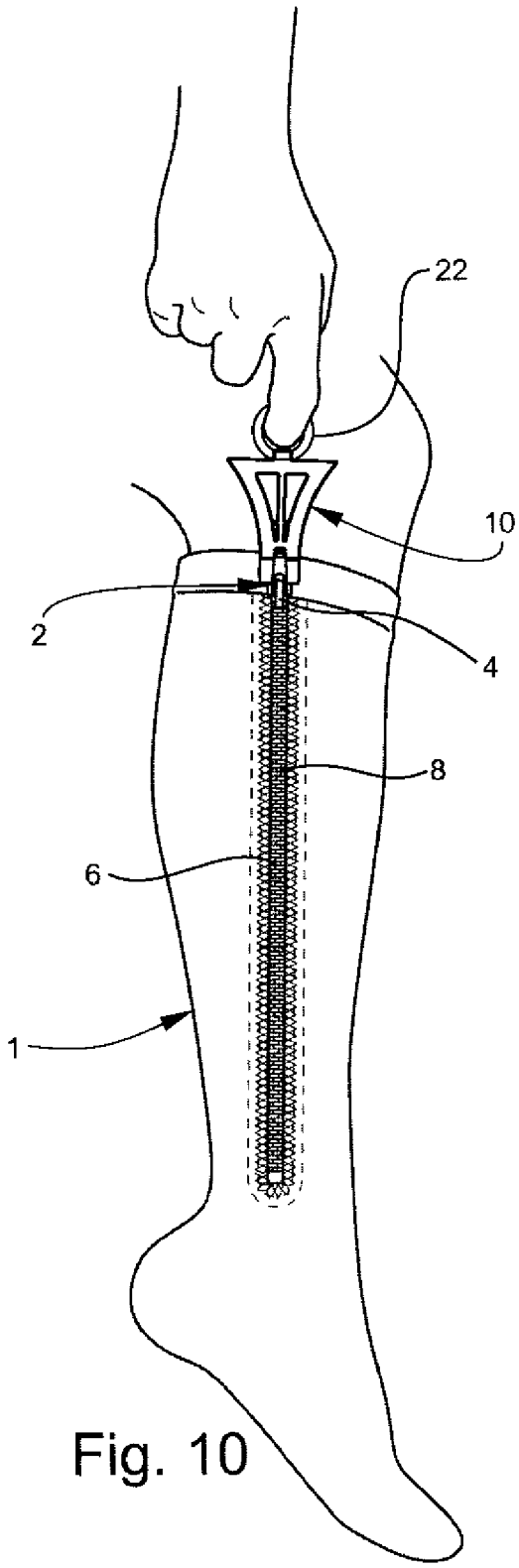
FIG. 10 is a front perspective view sequentially after the view of FIG. 9, showing the zipper assist device installed on the zipper track of the compression hose at the highest portion of the zipper track and engaged by a finger of the wearer while being pulled upwards to zip the zipper.
Figure 11:
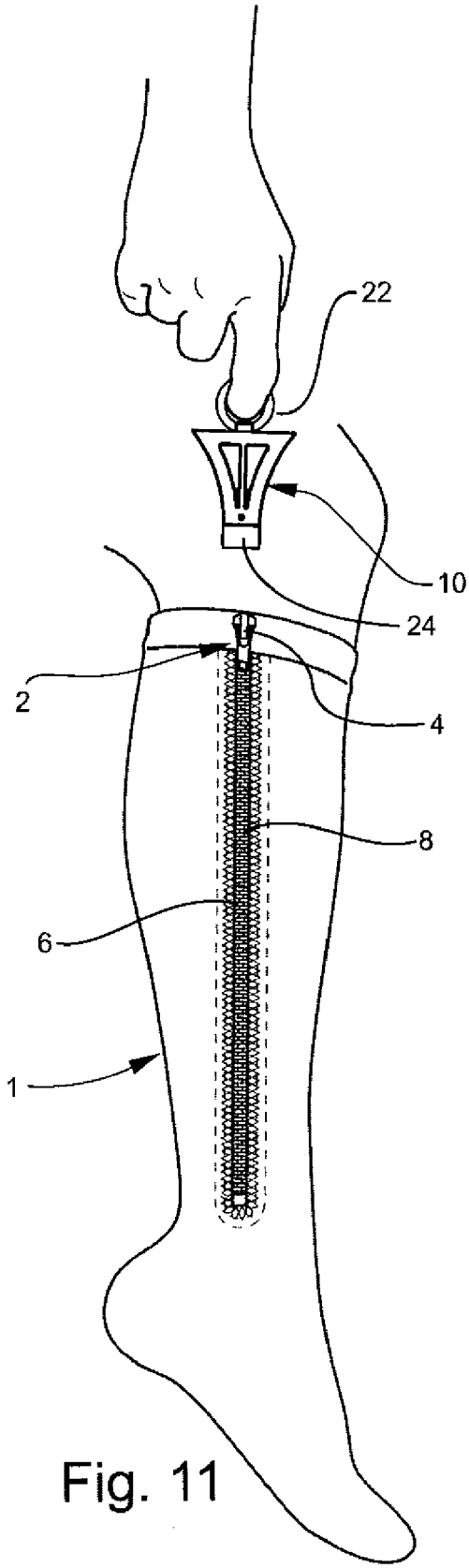
FIG. 11 is a front perspective view sequentially after the view of FIG. 10, wherein the zipper assist device is no longer installed on the zipper track of the compression hose and the compression hose is fully closed.

As shown in FIG. 8, once the zipper 2 is connected to the zipper assist device 10, the wearer then pulls on the pull 22 to impart zipping movement to the zipper assist device 10, which then imparts zipping movement to the zipper 2 as shown sequentially in FIGS. 8, 9, and 10. Once the zipper assist device 10 is at a most upward or zipped point on the zipper tracks 6, 8, the zipper assist device 10 is then removed from the zipper 2 by releasing the upper tab 5 from post 20. In preferred embodiments, the tab 5 is simply flipped away from the zipper assist device 10 to allow easy removal of the zipper assist device 10. In other embodiments, the zipper assist device 10 may be configured such that the zipper assist device 10 can be simply rotated towards the palm of the wearer's hand as shown in FIG. 9 such that the tab opening 5*a* releases from the post 20, thereby allowing easy removal of the zipper assist device 10. In the embodiment shown in FIG. 14, the flap 32 must be flipped or rotated out of the way to allow access to the tab opening 5*a*. A zipper closing angle $\alpha$ is shown in FIG. 7B. The zipper assisting device 10 works to maintain a consistent zipper closing angle $\alpha$ to reduce stresses on the zipper tracks. As shown in FIGS. 8 through 11, the zipper 2 is on a side of garment 1. In some embodiments, the zipper 2 may be positioned on a back or front side of the garment 1. It shall be appreciated that the zipper assist device 10 may be pulled by pull 22, or it may be pushed upwards by the patient pushing on the zipper 2.

Figure 12:
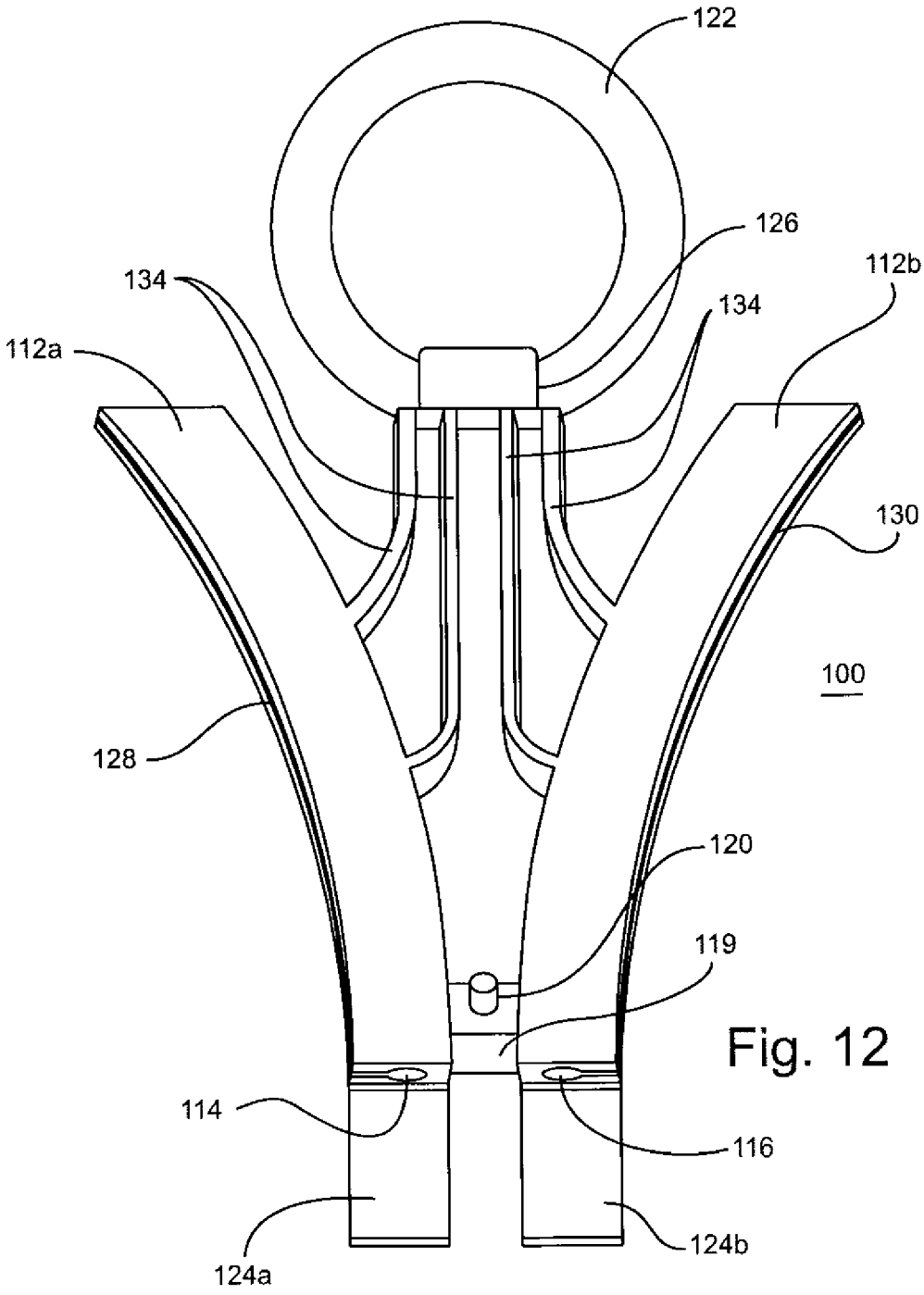
FIG. 12 is a front perspective view of a flexible zipper assist device according to an alternate embodiment.

An alternate embodiment of the zipper assist device is shown in FIG. 12 and is represented as 100. The zipper assist device 100 includes a pair of side members 112*a* and 112*b* forming a wedge-shaped body and a pair of channels 114, 116 formed on opposing sides of each respective side member 112*a*, 112*b*. A pull 122 is provided that interconnects with flexible support members 134. The flexible support members 134 connect to the side members 112*a*, 112*b*, forming a flexible semirigid structure that is capable of flexible movement during installation of the zipper assist device 100. As used herein, flexible shall refer to the ability of the zipper assist device 100 to flex under moderate pressure supplied by a human hand.

Just as is shown in the embodiment shown in FIGS. 1-11, the pull 122 is connected to the flexible support members 134 by a structure forming a hinged joint 126. The hinged joint 126 provides for rotation of the pull 122 so that the wearer can easily gain access to the pull 122 from a variety of angles. The zipper assist device 100 includes a generally diverging pair of guide channels 114, 116, each having respective access slots 128, 130.

The zipper assist device 100 does not need to be constructed in the identical shape shown in FIG. 12, and will be effective with any shape that has a generally diverging pair of guide channels 114, 116, and flexible support members 134. Each side member 112*a*, 112*b* includes an alignment plate 124*a*, 124*b*, respectively, positioned on the connection end of the each member 112*a*, 112*b*. Alignment plates 124*a* and 124*b* are adapted for sliding underneath and receiving the central slider 4. In this manner, the alignment plates 124*a*, 124*b* act to slide underneath the tracks 6, 8, providing guiding support for the central slider 4.

A cross member 119 spans between the support members 112*a* and 112*b* and carries a post 120 that is adapted for hooking the opening 5*a* of the pull tab 5. The post 120 projects from the cross member 119 and may optionally angle towards the pull 122 similar to the embodiment shown in FIG. 3. The post 120 may include a retaining lip in some embodiments.

Figure 13:
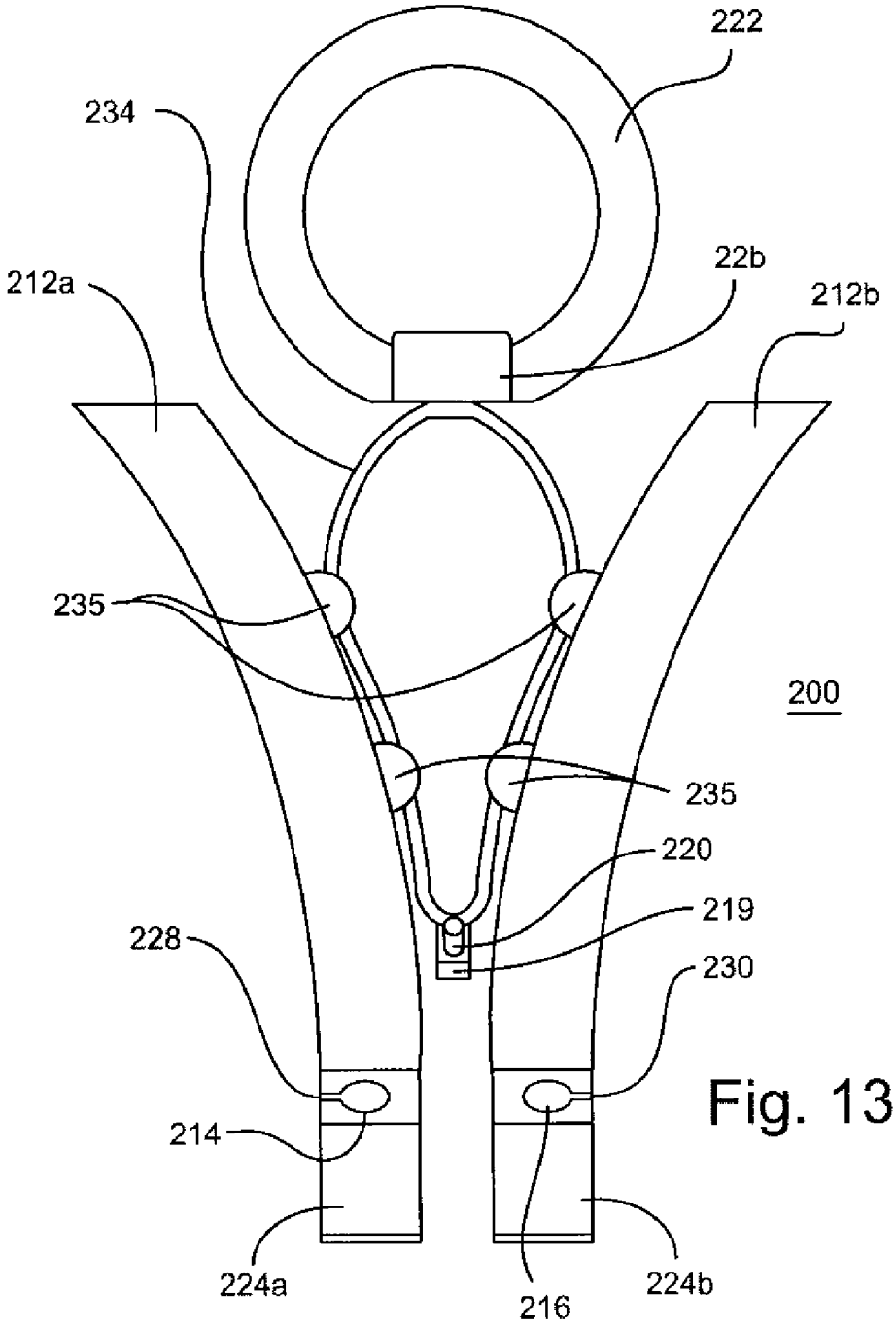
FIG. 13 is a front perspective view of a detachable zipper assist device according to another embodiment.

A further alternate embodiment of the zipper assist device is shown in FIG. 13 and is represented by 200. This embodiment shares the same elements as shown in FIG. 12, with the exception that a lace member 234 interconnects each support member 212*a*, 212*b*, via connection rings 235. The lace member 234 may be capable of being tied or may be one continuous strand. In some embodiments, the lace member 234 may be capable of stretching in order to fit various applications. A platform 219 carries a post 220 similar to the post 120 shown in FIG. 12 and post 20 shown in FIGS. 1-11. Zipper access slots 228 and 230 are provided as shown in the previous Figures.

A zipper assist device according to several embodiments is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A device for assisting in opening and closing a zipper having a central zipper slider that opens and closes a zipper by selectively disconnecting and connecting a pair of opposed interlockable tracks as the zipper slider moves in respective opening and closing directions along the tracks, comprising:

(a) a body having first and second diverging guide channels having mutually oriented closure angles for receiving the respective zipper tracks for sliding movement along the diverging guide channels and for permitting progressive interconnection of the interlockable tracks at the mutually oriented closure angles, wherein the body further includes an alignment plate positioned adjacent at a connection point of the connector and the zipper slider for providing sliding support to the zipper during pulling movement of the body for assisting and maintaining the device in alignment with the interlockable tracks;

(b) a connector carried by the body and extending from a major face of the body in a direction generally perpendicular to the major face for connecting the body to the zipper slider; and (c) a pull for permitting manual movement of the body.

2. The device according to claim 1, wherein the connector is an outwardly extending post carried by the body for extending through and engaging an opening in the zipper slider.

3. The device according to claim 1, wherein the body is a wedged shape.

4. The device according to claim 1, wherein the first and second diverging guide channels define a concave surface with respect to a centerline of the body.

5. The device according to claim 1, wherein the pull is attached to the body by a hinged joint.

6. The device according to claim 1, wherein each of the diverging guide channels further includes relatively narrow access slots positioned on a periphery of each of the diverging guide channels for receiving and retaining each of the interlockable tracks.

7. The device according to claim 1, wherein each of the diverging guide channels includes at least one hook for receiving a lace for tying the first and second diverging guide channels together and forming the body.

8. The device according to claim 1, wherein each of the diverging guide channels is attached with a flexible support member connecting to the pull and forming the body.

9. The device according to claim 1, further including a flap for engaging the connector and for retaining an opening of a tab of the zipper slider.

10. A device for assisting in closing a zipper having a central zipper slider for closing and unzipping the zipper by selectively disconnecting and connecting a pair of opposed interlockable tracks as the zipper slider moves in respective closing and unzipping directions along the tracks, comprising:

(a) a body having first and second outwardly concave diverging guide channels for receiving the respective zipper tracks for sliding movement along the diverging guide channels and for progressively interconnecting the interlockable tracks at a predetermined mutually oriented angle of closure, wherein the body further includes an alignment plate positioned adjacent at a connection point of the connector and the zipper slider for providing sliding support to the zipper during pulling movement of the body for assisting and maintaining the device in alignment with the interlockable tracks;

(b) an outwardly extending post carried by the body and extending from a major face of the body in a direction generally perpendicular to the major face for connecting the body to the zipper slider for being received by an opening in a zipper slider; and (c) a pull for permitting manual pulling movement of the body.

11. The device according to claim 10, wherein the pull is attached to the body by a hinged joint.

12. The device according to claim 10, wherein each of the diverging guide channels further includes relatively narrow access slots positioned on a periphery of each of the diverging guide channels for receiving and retaining each of the interlockable tracks.

13. The device according to claim 10, wherein each of the diverging guide channels includes at least one hook for receiving a lace for tying the first and second diverging guide channels together and forming the body.

* * * * *